United States Patent [19]

Cambreleng et al.

[11] Patent Number: 4,963,847

[45] Date of Patent: Oct. 16, 1990

[54] CIRCUIT BREAKER WITH TRANSPARENT TUBE MAGNETIC CORE HOLDER

[75] Inventors: Paul S. Cambreleng, Lambertville; George W. Ford, III, Lawrenceville, both of N.J.

[73] Assignee: Heinemann Electric Company, Lawrenceville, N.J.

[21] Appl. No.: 336,110

[22] Filed: Apr. 11, 1989

[51] Int. Cl.[5] ..... H01H 7/02

[52] U.S. Cl. ..... 335/59; 335/62

[58] Field of Search ..... 335/59–62, 335/35, 6, 239, 240, 241, 242; 29/523, 525, 602.1

[56] References Cited

U.S. PATENT DOCUMENTS 2,232,877 2/1941 Cartwright et al. ..... 335/62

3,729,696 4/1973 Pope .

4,237,436 12/1980 Setescak ..... 335/59

*Primary Examiner*—Leo P. Picard

*Assistant Examiner*—Lincoln Donovan

*Attorney, Agent, or Firm*—Dann, Dorfman, Herrell and Skillman

[57] ABSTRACT

Improvement in a circuit breaker employing a fixed pole piece associated with a movable magnetic core within a tube containing damping fluid wherein the side walls of the tube are transparent in order to facilitate the inspection of internal components. Calibrations can be provided on the side walls as well. Additionally, the tube is preferably made of resinous materials which is heat sealable to the end cap carrying the pole piece to which the breaker tripping armature is attracted by overload sensed by a coil surrounding the movable core and upon overload causing the armature to move to the pole piece and open the circuit breaker contact.

12 Claims, 1 Drawing Sheet

FIG. 1
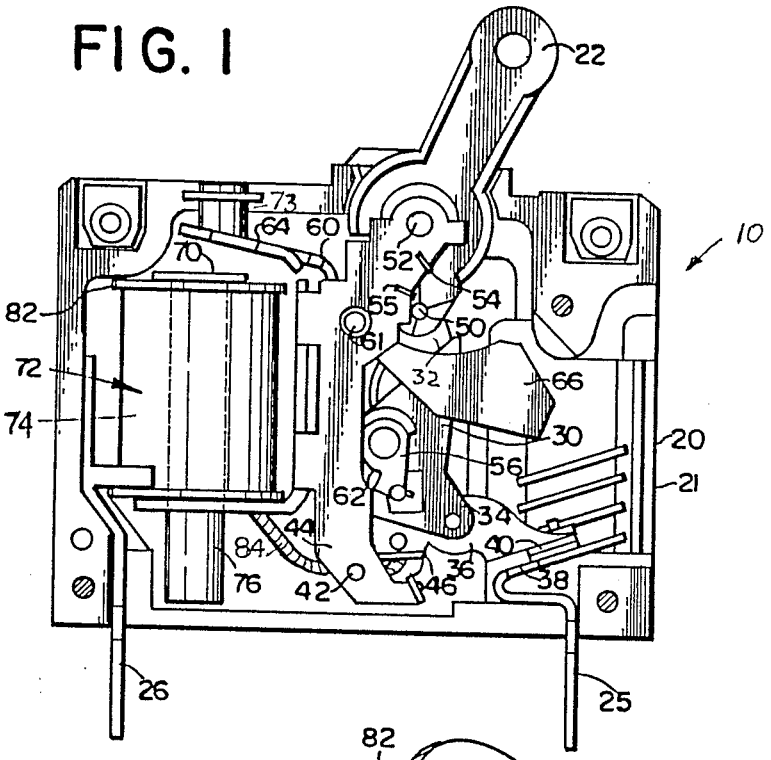
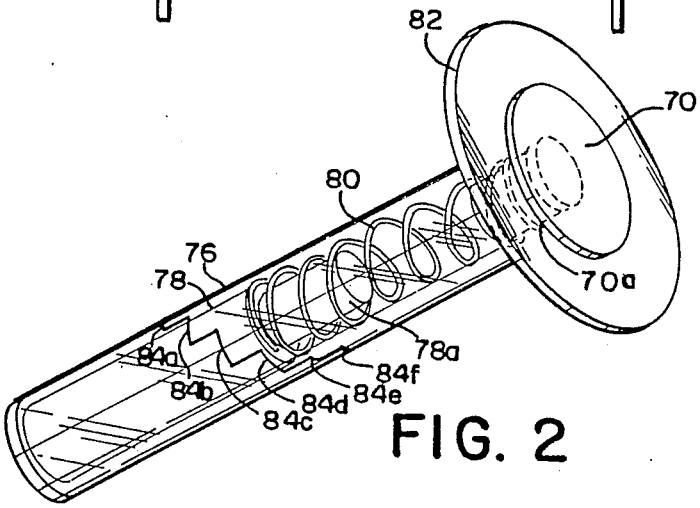
FIG. 2

CIRCUIT BREAKER WITH TRANSPARENT TUBE MAGNETIC CORE HOLDER

BACKGROUND OF THE INVENTION

The present invention relates to magnetic circuit breaker construction including a moveable magnetic core contained within a transparent tube. More specifically, the present invention relates to the use of a transparent tube which may be filled with liquids of varying viscosity, a core and spring, the assembly of which can be observed through the tube side walls, in order to control the rate of movement of the core toward a pole piece in response to overload currents tending to actuate the breaker contacts opened.

In the prior art the applicant's assignee has developed a variety of techniques for controlling the rate of movement of a moveable magnetic core toward a pole piece so as to actuate an armature to open breaker contact. One of the techniques employed is to employ liquids of different viscosity within the tube to control the rate of movement of the core and thus to vary the delay before the contacts open in response to an overload current. In the presence of ordinary levels of current the core will not be actuated. Frequently this is accomplished by a spring which opposes movement of the core until the force of the spring is effectively overcome. At that point how fast the contacts are opened depends upon how fast the magnetic core moves to the pole piece to attract the circuit breaker mechanism to open the contacts, which in turn depends upon the viscosity and the level of fluid in the tube. Because the tubes in the past have been opaque, it has been difficult to control the level of the filling of the tubes which is one of the parameters effecting the rate of movement of the core. The applicant has made the tube transparent so that the level of fluid and the quality of the assembly can be visually observed.

SUMMARY OF THE INVENTION

In accordance with the present invention the tube containing the magnetic core is made of transparent material whereby internal components can be visually observed and controlled.

Preferably in accordance with the present invention the transparent tube is made of heat sealable resinous material. Thus, by providing a suitable fixture, the tube can be filled to a predetermined level with a selected viscous material. A cap with a pole piece affixed to it may be placed on top of the tube and the tube and the cap thermally sealed saving much time and effort.

More specifically, the present invention concerns a circuit breaker comprising a protective circuit with a winding in series with switch contacts between a pair of terminals and a switch handle, which enables the closing of the switch contacts and a mechanism responsive to the winding for opening the contacts on overload. A non-magnetic tube is provided within the winding containing a core of magnetic material movable within the tube. The tube is oriented relative to the winding so that the core is urged by the magnetic field of the winding toward the pole when subjected to overload current. The core is biased by a spring away from the pole piece at one end of the tube and its movement is retarded by a viscous liquid. A moveable armature forms a part of the mechanism, which armature will open the closed contacts, whereby upon sustained overload the core moves toward the pole piece and when positioned sufficiently close to the pole piece will exert sufficient magnetic force on the armature to open the switch contacts. The improvement in this breaker comprises making at least the tube side walls of transparent material which enables observation of the correct assembly into the tube of the internal components, the core, a spring, and viscous fluid as well as the proper functions of these components in an energized inspection condition. Advantageously the tube is composed of a resinous material and preferably one that is heat sealable in order to seal the cap to the tube to retain the fluid.

The invention also concerns the method of preparing a pole piece structure for a magnetic circuit breaker comprising insertion of a magnetic core into a non-magnetic tube. A viscous fluid and a spring are selected as damping agents for the core. The viscous fluid is then fed into the tube until it reaches a predetermined calibrated level. The tube is then closed with an end cap containing a magnetic pole piece so as to retain the fluid.

THE DRAWINGS

For a better understanding of the present invention reference is made to the accompanying drawings in which:

FIG. 1 is a side elevation illustrating a circuit breaker incorporating the present invention with one-half of the case removed to show the general internal arrangement of a typical circuit breaker mechanism with the contacts in closed position; and FIG. 2 is a perspective view of a transparent tube container for a magnetic core in accordance with the present invention showing the core, spring, cap and pole piece in place.

DETAILED DESCRIPTION

Referring to the drawings, FIG. 1 illustrates a circuit breaker 10 generally similar to the one disclosed in U.S. Pat. Nos. 3,329,913, issued to William W. Camp, and No. 4,267,539, issued to Thomas Guinan and both assigned to Heinemann Electric Company. For a more complete description of the mechanism of this circuit breaker reference should be made to the earlier of the reference patents. The circuit breaker is housed in an insulating case 20 formed by abutting substantially half-cases, only the half-case 21 being illustrated in FIG. 1. An operating handle 22 protrudes through an opening in the edge of case 20. Terminals 25 and 26 enable connecting the circuit breaker to a load.

Connected to the operating handle 22 is a linkage 30 comprising toggle links 32 and 34 and movable arm 36. The terminal 25 supports a stationary contact 38 which cooperates with a movable contact 40, the latter being carried by the movable arm 36. The movable arm 36 pivots about a pintle 42, carried by a metal channel frame 44, and is biased by a spring 46 to the open position of the contacts.

The toggle link 34 is pivotally connected to the movable arm 36 at one end and to the toggle link 32 at the other end to form the knee of the toggle, the link 32 being pivotally connected at its upper end to the handle 22 by a pintle 50. The handle 22 oscillates about a fixed pintle 52 which is carried by the frame 44 and is biased to the "off" position of the contacts by a reset spring 54, the spring 54 also resetting the toggle linkage upon tripping of the mechanism.

For locking the toggle in the overcenter position during automatic resetting, the toggle link 32 engages a latch 56 carried by the link 34.

The latch 56 is tripped by a pivotal armature 60 having three arms, namely an unlatching arm 62, an attracted arm 64 and a balance arm 66. The unlatching arm 62 engages the latch 56 and turns it to unlatch the toggle, thereby allowing the toggle to collapse under the bias of the spring 46, when the armature arm 64 is attracted (upon sufficient overload), toward the pole piece 70 of an electromagnet device 72. The armature 60 is pivotally mounted on a pintle 61 carried by the frame 44 and biased by a spring 55 in the clockwise direction, as viewed in FIG. 1, biasing the attracted end 64 away from the pole piece 70 and into engagement with the cam 73 of this invention.

The structure described is but one of many possible configurations for the present invention. The invention relates to the electromagnetic device 72 which may also have different embodiments in accordance with the present invention.

The electromagnetic device 72 as disclosed herein further comprises a solenoid coil 74 about a tube 76. The tube 76, as seen in FIG. 2, is of non-magnetic material and houses a movable core 78 of magnetizable material biased by a spring 80 toward the lower end of the tube and is retarded in its upward movement by a liquid, preferably a silicone oil, within the tube 76 to provide a time delay below certain overload currents before tripping of the circuit breaker takes place. The coil 74 has one end connected to the movable arm 36 by a flexible conductor 84 and the other end connected by a conductor 86 to the terminal 26. Thus, an electromagnetic tripping device or sensing element is formed by the coil 74, the tube 76, the movable core 78, and the armature 60 for tripping the circuit breaker after a time delay period at certain overloads or substantially instantaneously at other, higher overloads.

The tube 76 can be constructed of any transparent material but the side walls and bottom are advantageously cast of a suitable transparent resinous material. Alternatively, the side walls alone can be transparent. Transparency allows the level of the filling viscous fluid to be generally observed as it is being accomplished. Advantageously the tube is composed of an injection moldable resinous material which preferably has the following qualities: (a) a chemical resistance to the fluid so that the fluid may not leach out of or breakdown the material of it's container; (b) electrically non-conductivity, so as not to add to the eddy current losses in the magnetic circuit; (c) transparency so that a visual inspection can be made of the condition and motion of the internal components; (d) heat sealable in order to seal the cap to the tube to retain the fluid; (e) capable of withstanding the heat generated by the solenoid coil; (f) capable of withstanding the impact of the core when it is magnetically drawn to the pole piece during an overload condition; and (g) capable of withstanding the heat generated expansion of the internal components. The technique is for the tube to be held generally vertically with its upper end open and the core 78 to be inserted. The core has a necked down portion **78*a* which provides a shoulder against which spring 80 rests and which confines the end of the helical spring. The spring 80 may then be put in place or withheld until the fluid is in place. As the fluid of desired viscosity is introduced, its level is carefully observed until a predetermined desired level is achieved, at which time addition of fluid is discontinued. The cap 82** is then put in place and sealed such that the fluid is retained within the tube so that it can not leak out.

Advantageously the pole piece 70 is molded in the end cap 82 and has an extension **70*a* through the cap 82 of which fits within the end turns of helical spring 80 to help hold it in place at the cap end of the tube. It is of substantial advantage if the material of the tube 80 and the cap 82 are such that they can be thermally heat sealed together and use of certain moldable resinous materials such as polyethersulfone permit this to be done. In the simplest type of arrangement the tube 80 may be assembled with the top 82** put into a sealing fixture and the region of seal may be heated for the heat sealing to occur. While the top and the side walls need not be the same material, such similarity may facilitate in the heat sealing in some instances.

Still another feature of the invention is the ability to inspect the movements of the core 78, the spring 80 and the fluid with respect to one another during various energized states of the solenoid coil, thus allowing for visual evaluations of these internal components.

An optional feature of the invention is the provision of calibration marks in connection with the tube such that the calibration marks **84*a*, 84*b*, 84*c*, 84*d*, 84*e*, 84*f***, etc. showing progressive axial levels, which may be selected to assure consistent filling of the tubes with a material of the selected type for a predetermined desired response time under specified current overload conditions. The calibration marks may be molded into a resinous tube or etched into glass-like materials and may take the form of the step pattern shown or simply may be conventional successive circumferential or partial circumferential marks around the tube. In most instances it will be desirable to place the calibration marks at regular uniform intervals but in certain applications non-uniform intervals may be desirable. In some cases the calibration marks may be numbered or otherwise identified with some sort of designators so as to more readily identify the volume or effect that a particular mark represents so that filling to similar levels in similar tubes allow consistent repeatable operation.

Just as the specific type of mechanism shown is not necessary to the present invention and any circuit breaker mechanism can be used, the type of tube employed can be varied considerably and can have various shapes and sizes and be made of a variety of materials and may be placed in varying locations within the circuit breaker. Although a horizontal orientation is usually provided, and preferred, other types of orientation may be used with suitable design criteria.

Other modifications will occur to those skilled in the art. All such modifications within the scope of the claims are intended to be within the scope and spirit of the present invention.

I claim:

1. In a circuit breaker comprising switch contacts connected to terminals and connectable into a protected circuit and a winding in circuit between a terminal and a contact, including a switch handle, which enables at least the closing of the switch contacts and a mechanism for opening the contacts on overload including, a non-magnetic tube within the winding containing a solid core of magnetic material movable within the tube in a viscous liquid, the core being biased away from a pole piece at one end of the tube, the tube being oriented relative to the winding so that the core is urged by the magnetic field of the winding toward the pole when subject to overload current and a movable armature forming part of the mechanism, movement of which armature will open the closed contacts, whereby upon sustained overload the core moves toward the pole piece and when positioned sufficiently close to the pole piece will exert sufficient magnetic force on the armature to open the switch contacts, the improvement comprising making at least the tube side walls of material through which the level of the viscous liquid in the tube may be visibly checked.

2. The circuit breaker of claim 1 in which side walls of the tube are composed of transparent resinous material.

3. The circuit breaker of claim 2 in which the entire tube is a one piece construction in which the tube is comprised of resinous heat sealable material.

4. The circuit breaker of claim 3 in which the end cap containing the pole piece is heat sealed to the tube to prevent escape of fluid.

5. The circuit breaker according to claim 1 in which the core and pole piece are biased apart by a coil spring contacting at its ends parts of the respective core and pole piece.

6. The circuit breaker according to claim 2 in which the core and pole piece are biased apart by a coil spring contacting at its ends parts of the respective core and pole piece.

7. The circuit breaker according to claim 3 in which the core and core piece are biased apart by a coil spring contacting at its ends parts of the respective core and pole piece.

8. The circuit breaker according to claim 4 in which the core and core piece are biased apart by a coil spring contacting at its ends parts of the respective core and pole piece.

9. The circuit breaker according to claim 1 in which the side walls of the tube are marked to indicate desired liquid level.

10. The circuit breaker according to claim 2 in which the side walls of the tube are marked to indicate desired liquid level.

11. The circuit breaker according to claim 3 in which the side walls of the tube are marked to indicate desired liquid level.

12. The circuit breaker according to claim 4 in which the side walls of the tube are marked to indicate desired liquid level.

* * * * *

UNITED STATES PATENT AND TRADEMARK OFFICE

CERTIFICATE OF CORRECTION

PATENT NO. : 4,963,847

DATED : October 16, 1990

INVENTOR(S) : Paul S. Cambreleng and George W. Ford, III

It is certified that error appears in the above-identified patent and that said Letters Patent is hereby corrected as shown below:

On the title page:

Abstract, line 7, "materials" should be --material--.

Claim 7, line 2, "core", (second occurrence) should be --pole--.

Claim 8, line 2, "core", (second occurrence) should be --pole--.

Signed and Sealed this

Sixth Day of October, 1992

*Attest:*

DOUGLAS B. COMER

*Attesting Officer*

*Acting Commissioner of Patents and Trademarks*